US009623460B2

(12) United States Patent
Hwang et al.

(10) Patent No.: US 9,623,460 B2
(45) Date of Patent: Apr. 18, 2017

(54) NET-SHAPED DUCT FORMING APPARATUS

(71) Applicant: The Boeing Company, Chicago, IL (US)

(72) Inventors: Peter K. Hwang, Kent, WA (US); Kenneth P. Zaballos, Burien, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 15/062,303

(22) Filed: Mar. 7, 2016

(65) Prior Publication Data

US 2016/0256908 A1 Sep. 8, 2016

Related U.S. Application Data

(62) Division of application No. 12/128,281, filed on May 28, 2008, now Pat. No. 9,296,031.

(51) Int. Cl.

| | |
|---|---|
| ***B21C 37/06*** | (2006.01) |
| ***B21D 22/12*** | (2006.01) |
| ***B21D 37/14*** | (2006.01) |

(52) U.S. Cl.

CPC ..... *B21C 37/06* (2013.01); *B21D 22/125* (2013.01); *B21D 37/14* (2013.01)

(58) Field of Classification Search

CPC .... B21D 22/10; B21D 22/105; B21D 22/125; B21D 37/14; B21D 26/02; B21D 26/033

See application file for complete search history.

(56) References Cited

U.S. PATENT DOCUMENTS

| | | | | |
|---|---|---|---|---|
| 3,595,047 A | | 7/1971 | Fanning et al. | |
| 3,953,994 A | * | 5/1976 | Brawner | B21D 22/105 72/58 |
| 4,068,372 A | | 1/1978 | Kamohara et al. | |
| 4,387,507 A | | 6/1983 | Kelly | |
| 4,418,457 A | * | 12/1983 | Mueller | B21D 39/06 72/58 |

(Continued)

FOREIGN PATENT DOCUMENTS

| | | | |
|---|---|---|---|
| GB | 2240944 A | | 8/1991 |
| JP | 61007028 A | | 1/1986 |
| JP | 05154569 A | * | 6/1993 |

OTHER PUBLICATIONS

USPTO translation of JP61007028.*

(Continued)

*Primary Examiner* — Edward Tolan
*Assistant Examiner* — Pradeep C Battula
(74) *Attorney, Agent, or Firm* — Yee & Associates, P.C.

(57) ABSTRACT

A duct-forming apparatus includes an apparatus frame, a forming piston assembly having a cylinder carried by the apparatus frame and a forming piston extendable from the cylinder. A duct-shaping assembly includes a form die having a form die interior and a forming surface provided in the form die interior; a forming assembly having a plurality of expandable forming sections provided in the form die adjacent to the forming surface; and a plurality of piston openings provided in the expandable forming sections, respectively, and adapted to receive the forming piston of the forming piston assembly. A duct-forming method is also disclosed.

21 Claims, 6 Drawing Sheets

(56) References Cited

U.S. PATENT DOCUMENTS

| | | | | |
|---|---|---|---|---|
| 4,532,845 | A * | 8/1985 | Jinnouchi | B21D 28/12 83/552 |
| 4,567,631 | A | 2/1986 | Kelly | |
| 4,685,191 | A | 8/1987 | Mueller et al. | |
| 5,119,658 | A * | 6/1992 | de Smet | B21D 22/10 72/348 |
| 7,287,406 | B2 | 10/2007 | Hwang | |
| 9,296,031 | B2 * | 3/2016 | Hwang | B21D 22/125 |
| 2009/0293579 | A1 | 12/2009 | Hwang et al. | |

OTHER PUBLICATIONS

Office Action, dated Jul. 8, 2011, regarding U.S. Appl. No. 12/128,281, 9 pages.
Final Office Action, dated Jan. 26, 2012, regarding U.S. Appl. No. 12/128,281, 8 pages.
Office Action, dated Jun. 15, 2012, regarding U.S. Appl. No. 12/128,281, 9 pages.
Final Office Action, dated Nov. 6, 2012, regarding U.S. Appl. No. 12/128,281, 11 pages.

* cited by examiner

NET-SHAPED DUCT FORMING APPARATUS

This application is a divisional application of U.S. patent application Ser. No. 12/128,281, filed May 28, 2008.

TECHNICAL FIELD

The disclosure relates to seal support ducts. More particularly, the disclosure relates to a net-shaped duct forming apparatus and method which are suitable for forming a net-shaped seal support duct by pressing a preformed duct against a forming surface in a form die using an expanding semi-solid media.

BACKGROUND

Currently, the process which is used to fabricate seal support rings or ducts may require multiple operations including emulsion cleaning, deburring, end trimming, bulge forming, laser trimming and etch cleaning. Consequently, the conventional fabrication process may engender waste of material and manpower as well as ergonomic problems associated with the deburring process.

SUMMARY

The disclosure is generally directed to a duct-forming apparatus. An illustrative embodiment of the duct-forming apparatus includes an apparatus frame, a forming piston assembly having a cylinder carried by the apparatus frame and a forming piston extendable from the cylinder. A duct-shaping assembly includes a form die having a form die interior and a forming surface provided in the form die interior; a forming assembly having a plurality of expandable forming sections provided in the form die adjacent to the forming surface; and a plurality of piston openings provided in the expandable forming sections, respectively, and adapted to receive the forming piston of the forming piston assembly.

The disclosure is generally further directed to a duct-forming method. An illustrative embodiment of the duct-forming method includes providing a form die having an interior forming surface, providing a forming assembly having a plurality of expandable forming sections, providing a pre-formed duct, placing the pre-formed duct in the form die, placing the forming assembly in the pre-formed duct, forming the pre-formed duct by expanding the expandable forming sections against the pre-formed duct and removing the duct from the form die.

BRIEF DESCRIPTION OF THE ILLUSTRATIONS

DETAILED DESCRIPTION

Figure 1:
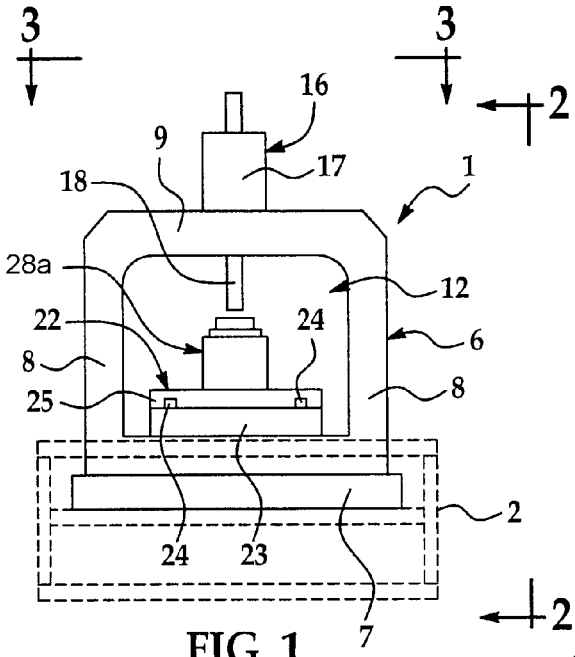
FIG. 1 is an end view of an illustrative embodiment of the net-shaped duct forming apparatus.

Referring initially to FIGS. 1-3 and 9-11, an illustrative embodiment of a net-shaped duct forming apparatus, hereinafter duct-forming apparatus, is generally indicated by reference numeral 1. The duct-forming apparatus 1 may include a support frame 2 (shown in phantom). An apparatus frame 6 may be provided on the support frame 2. The apparatus frame 6 may include, for example, an apparatus frame base 7 which may be supported by the support frame 2. Multiple vertical frame members 8 may extend upwardly from the apparatus frame base 7. Horizontal frame members 9 may extend between the vertical frame members 8. The vertical frame members 8 and horizontal frame members 9 may define a frame interior 12.

Figure 2:
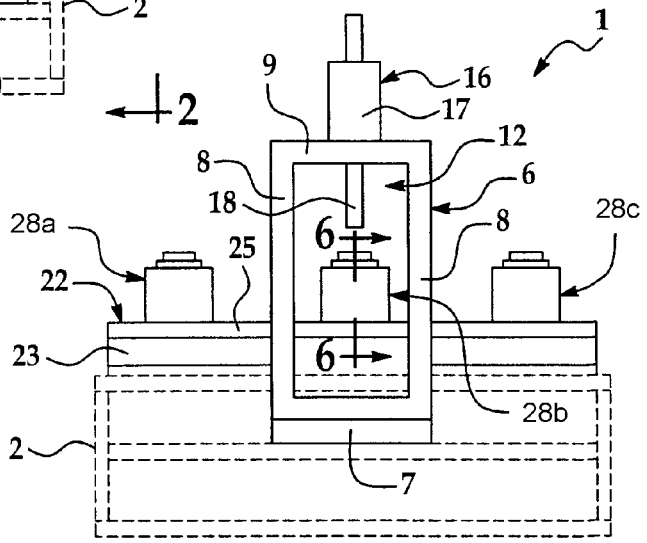
FIG. 2 is a side view, taken along lines 2-2 in FIG. 1, of an illustrative embodiment of the net-shaped duct forming apparatus.
Figure 3:
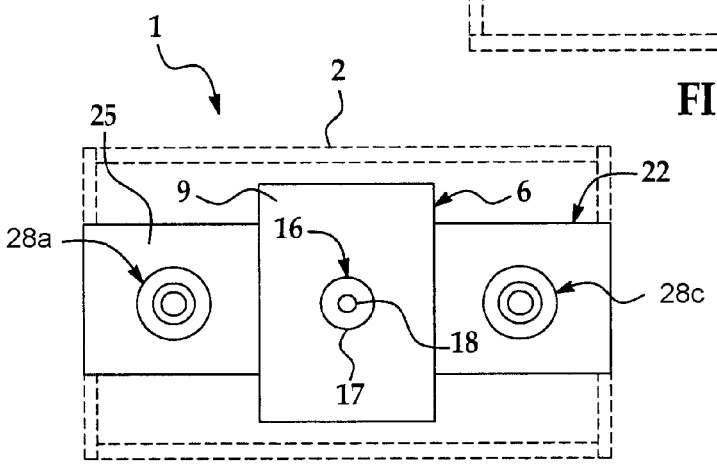
FIG. 3 is a top view, taken along lines 3-3 in FIG. 1, of an illustrative embodiment of the net-shaped duct forming apparatus.

A forming piston assembly 16 may be provided on the apparatus frame 6. The forming piston assembly 16 may include a cylinder 17, which may be hydraulic, and a forming piston 18 which is selectively extendable from and retractable into the cylinder 17. As shown in FIGS. 1 and 2, the forming piston 18 may be extendable from the cylinder 17 into the frame interior 12 of the apparatus frame 6 for purposes which will be hereinafter described.

Figure 8:
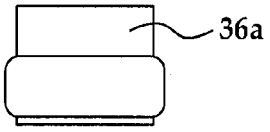
FIG. 8 is a side view of the formed duct, removed from the form die.
Figure 9:
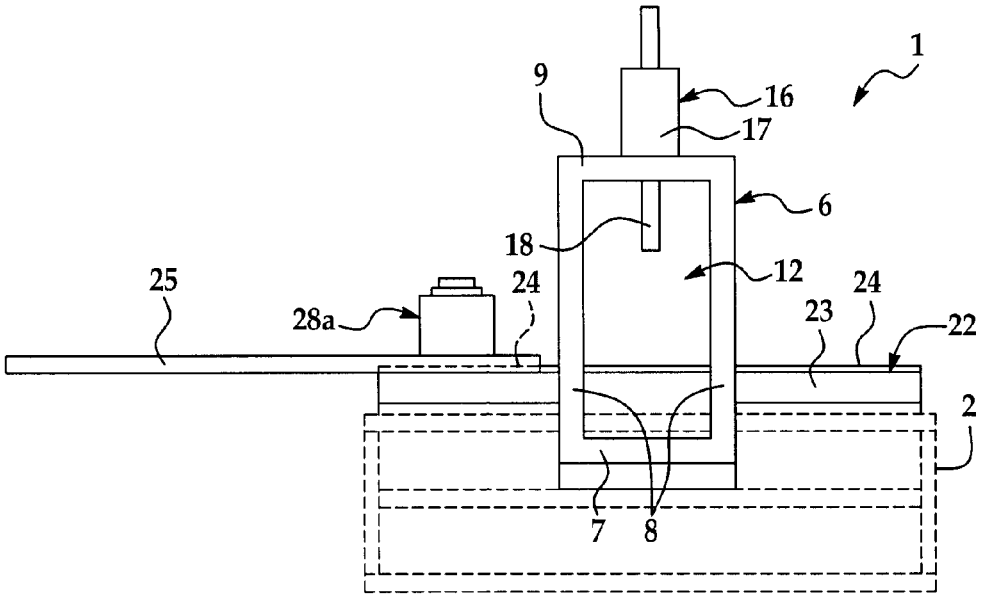
FIGS. 9-11 are side views, respectively, of an illustrative embodiment of the net-forming apparatus, illustrating sequential operation of the duct-forming apparatus.
Figure 10:
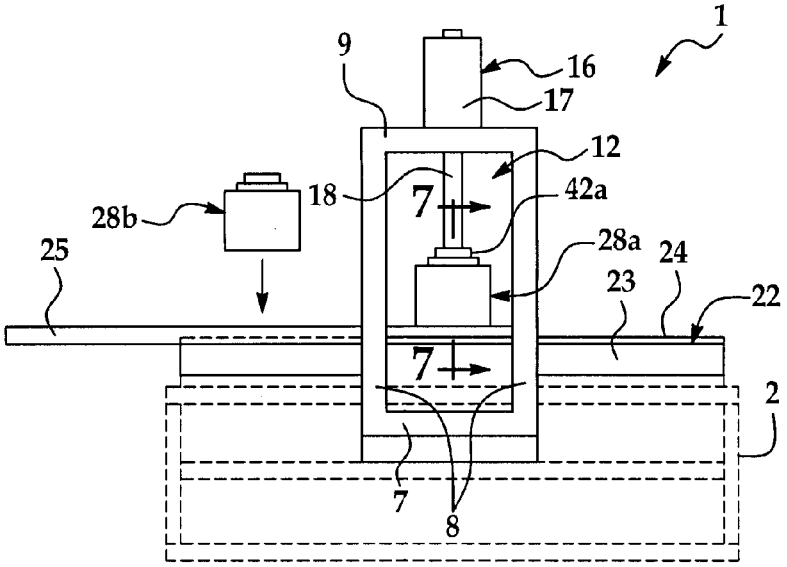
Figure 11:
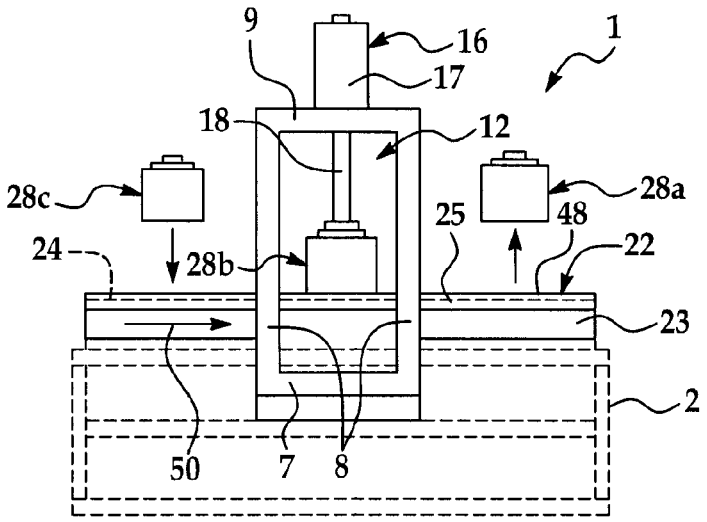

A generally horizontal traversing apparatus 22 may extend through the frame interior 12 of the apparatus frame 6. The traversing apparatus 22 may include, for example, a generally elongated platform base 23; a pair of spaced-apart platform rails 24 (FIG. 1) provided on the platform base 23; and a generally elongated, rectangular support platform 25 which slidably engages the platform rails 24. Accordingly, as shown in FIGS. 9-11, the support platform 25 may be adapted for bidirectional displacement on the platform rails 24 for purposes which will be hereinafter described. In application of the duct-forming apparatus 1, which will be hereinafter described, one or multiple duct-shaping assemblies 28*a*-28*c*, each of which contains a pre-formed duct 36 (FIG. 4), may be placed on the support platform 25 of the traversing apparatus 22. The support platform 25 may transport the duct-shaping assembly or assemblies 28*a*-28*c* through the frame interior 12 of the apparatus frame 6 to facilitate fabrication of a formed duct 36*a* (FIG. 8) from the pre-formed duct 36 (FIG. 4) by operation of the forming piston assembly 16. The pre-formed duct 36 may be titanium, or any other suitable metal.

Figure 4:
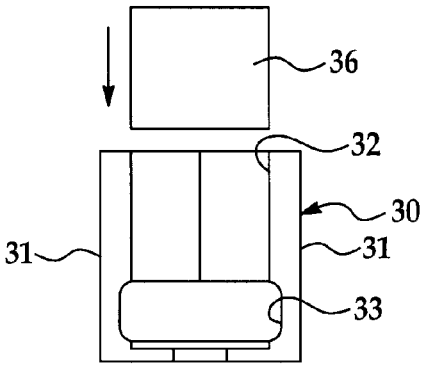
FIG. 4 is a sectional view of a form die, illustrating placement of a pre-formed duct into the form die.
Figure 5:
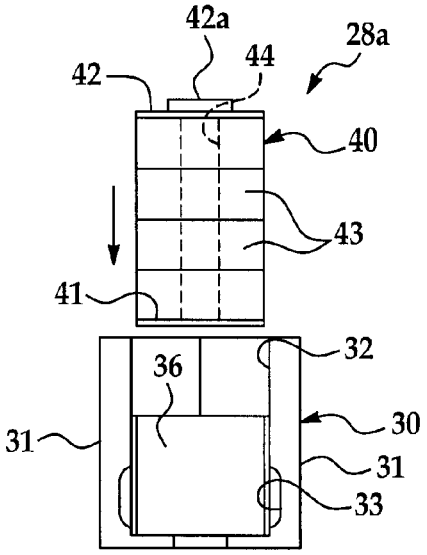
FIG. 5 is a sectional view of the form die with the pre-formed duct seated therein, illustrating placement of a forming assembly into the form die.

Referring next to FIGS. 4-7 of the drawings, each duct-shaping assembly 28*a*-28*c* (FIGS. 5-7) may include a form die 30 which may have a pair of complementary mating form die sections 31 (one of which is shown). The form die 30 has a form die interior 32. A forming surface 33 in the interior surface of the form die interior 32 has a configuration which is complementary to that of the desired shape of the formed duct 36*a*. As shown in FIGS. 4 and 5, the form die interior 32 of the form die 30 is sized and configured to receive and seat the pre-formed duct 36 preparatory to formation of the formed duct 36*a*, as will be hereinafter described.

Figure 6:
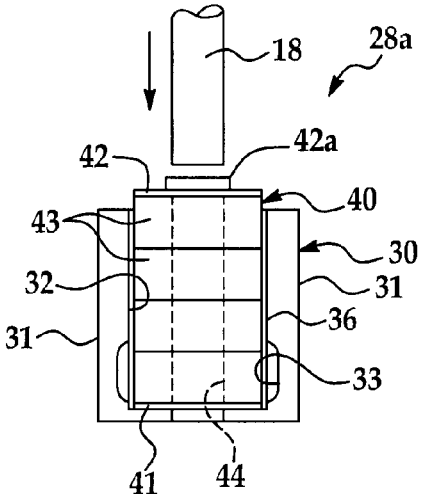
FIG. 6 is a sectional view, taken along section lines 6-6 in FIG. 2, of the form die with the pre-formed duct and forming assembly placed therein, preparatory to insertion of a piston through the forming assembly.
Figure 7:
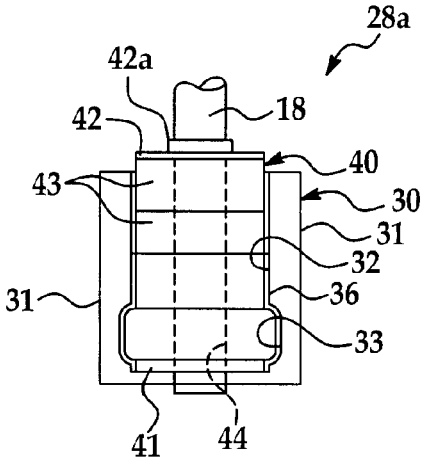
FIG. 7 is a sectional view, taken along section lines 7-7 in FIG. 10, of the form die with the pre-formed duct and forming assembly placed therein, illustrating insertion of the piston through the forming assembly and outward expansion of the forming assembly against the pre-formed duct to shape the pre-formed duct into a formed duct.

Each duct-shaping assembly 28*a*-28*c* may include a forming assembly 40 which is seated in the form die interior 32 of the form die 30 and extends through the pre-formed duct 36, as shown in FIGS. 5 and 6. Each forming assembly 40 may include a bottom assembly plate 41, a top assembly plate 42 which is spaced-apart from the bottom assembly plate 41 and multiple expandable forming sections 43 which are sandwiched between the bottom assembly plate and the top assembly plate 42. A piston guide collar 42*a* may be provided on the top assembly plate 42. Each of the forming sections 43 may be an expandable semi-solid medium such as polyurethane, or any other engineered elastomer. The forming sections 43 of the forming assembly 40 may vary from each other in hardness. Piston openings (shown in phantom) may extend centrally through the respective expandable forming sections 43 and may register with the piston guide collar 42*a* on the top assembly plate 42. In operation of the net-forming apparatus 1, which will be hereinafter described, the forming piston 18 (FIGS. 1-3) of the forming piston assembly 16 is extended through the piston openings 44 of the forming sections 43. The diameter of the forming piston 18 may be greater than the diameter of each the piston openings 44. Accordingly, as it is extended through the piston openings 44, as shown in FIG. 7, the forming piston 18 causes the forming sections to expand outwardly against the pre-formed duct 36. Consequently, the forming sections 43 push the pre-formed duct 36 against the interior forming surface 33 of the form die 30 and the pre-formed duct 36 conforms to the contour of the forming surface 33, forming the formed duct 36*a* (FIG. 8).

Referring next to FIGS. 4-11, in typical operation of the duct-forming apparatus 1, a first duct-shaping assembly 28*a* may initially be assembled and placed on the support platform 25 of the traversing apparatus 22, as shown in FIG. 9. Accordingly, a form die 30 (FIG. 4) may initially be placed on the support platform 25. As shown in FIG. 4, a generally cylindrical pre-formed duct 36 may then be seated in the form die interior 32 of the form die 30. A forming assembly 40 may then be seated in the form die interior 32 of the form die 30 and extend through the pre-formed duct 36, as shown in FIG. 6, to complete the first duct-shaping assembly 28*a* (FIG. 9).

As shown in FIG. 10, the support platform 25 may be moved along the platform base 23 of the traversing apparatus 22 to position the first duct-shaping assembly 28*a* in alignment with the forming piston 18 of the forming piston assembly 16. Simultaneously, a second duct-shaping assembly 28*b* may be placed on the support platform 25 in generally adjacent relationship to the first duct-shaping assembly 28*a*. Next, as further shown in FIG. 10, the forming piston 18 may be extended from the cylinder 17 of the forming piston assembly 16 and through the piston guide collar 42*a* on the top plate 42 of the forming assembly 40. As shown in FIGS. 6 and 7, the forming piston 18 is extended through the central piston openings 44 in the respective expandable forming sections 43 of the forming assembly 40. Accordingly, as it is extended through the piston openings 44, as shown in FIG. 7, the forming piston pushes outwardly against the forming sections 43 and causes the forming sections 43 to expand outwardly against the pre-formed duct 36. Consequently, the pre-formed duct 36 is pushed against the interior forming surface 33 of the form die 30 and conforms to the contour of the forming surface 33, forming the formed duct 36*a* (FIG. 8). In some applications, the expandable forming sections 43 of the forming assembly 40 may differ from each other in hardness. This may facilitate control over localized deformation of the walls of the pre-formed duct 36, providing a substantially defect-free formed duct 36*a* having homogenous wall thickness. Furthermore, the formed duct 36*a* may not require additional manufacturing finishing steps such as trim and deburring, for example.

The forming piston 18 is retracted back into the cylinder 17 of the forming piston assembly 16 and is therefore removed from the piston openings 44 of the expandable forming sections 43. As shown in FIG. 11, the support platform 25 may be moved along the platform base 23 until the first duct-shaping assembly 28*a* is located in an unloading position 48 for unloading of the first duct-shaping assembly 28*a* from the traversing apparatus 22. Simultaneously, the second duct-shaping assembly 28*b* is located in the frame interior 12 (FIG. 9) of the apparatus frame 6 to receive the forming piston 18 and form a second formed duct 36*a* in the second duct-shaping assembly 28*b* by operation of the forming piston assembly 16, as shown in FIG. 11. The first duct-shaping assembly 28*a* (FIGS. 9-11) is disassembled by removing the forming assembly 40 and the formed duct 36*a* from the form die 30. As shown in FIG. 11, a third duct-shaping assembly 28*c* may be placed on the support platform 25 preparatory to formation of a third formed duct 36*a* in the third duct-shaping assembly 28*c*. Accordingly, as the support platform 25 moves on the platform base 23 to the right as indicated by the arrow 50 in FIG. 11, the second duct-shaping assembly 28*b* is moved to the unloading position 48 whereas the third duct-shaping assembly 28*c* is moved into the frame interior 12 of the apparatus frame 6 for fabrication of a third formed duct 36*a*.

Figure 12:
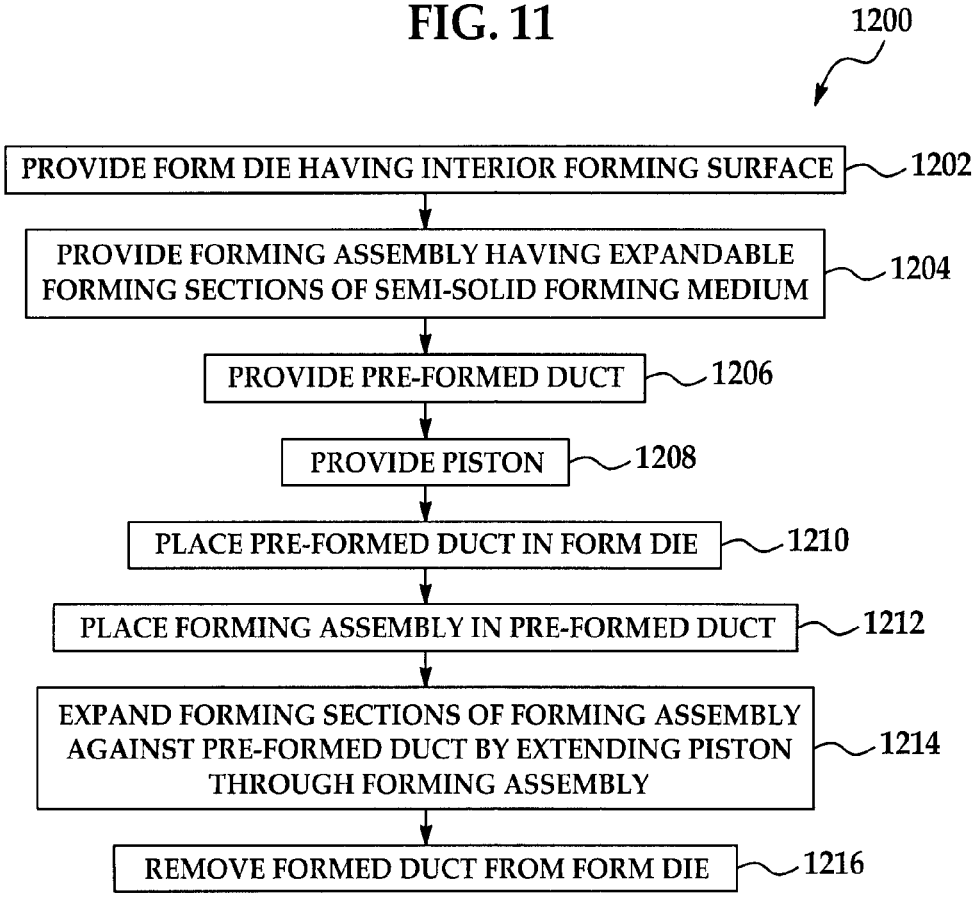
FIG. 12 is a flow diagram which illustrates an illustrative embodiment of the net-shaped duct forming method.

Referring next to FIG. 12, a flow diagram 1200 which illustrates an illustrative embodiment of a duct-forming method is shown. In block 1202, a form die having an interior forming surface is provided. In block 1204, a forming assembly having expandable forming sections of semi-solid forming medium is provided. In block 1206, a pre-formed duct is provided. In block 1208, a piston is provided. In block 1210, the pre-formed duct is placed in the form die. In block 1212, the forming assembly is placed in the pre-formed duct. In block 1214, the forming sections of the forming assembly are expanded against the pre-formed duct by extending the piston through the forming assembly. In block 1216, the formed duct is removed from the form die.

Figure 12A:
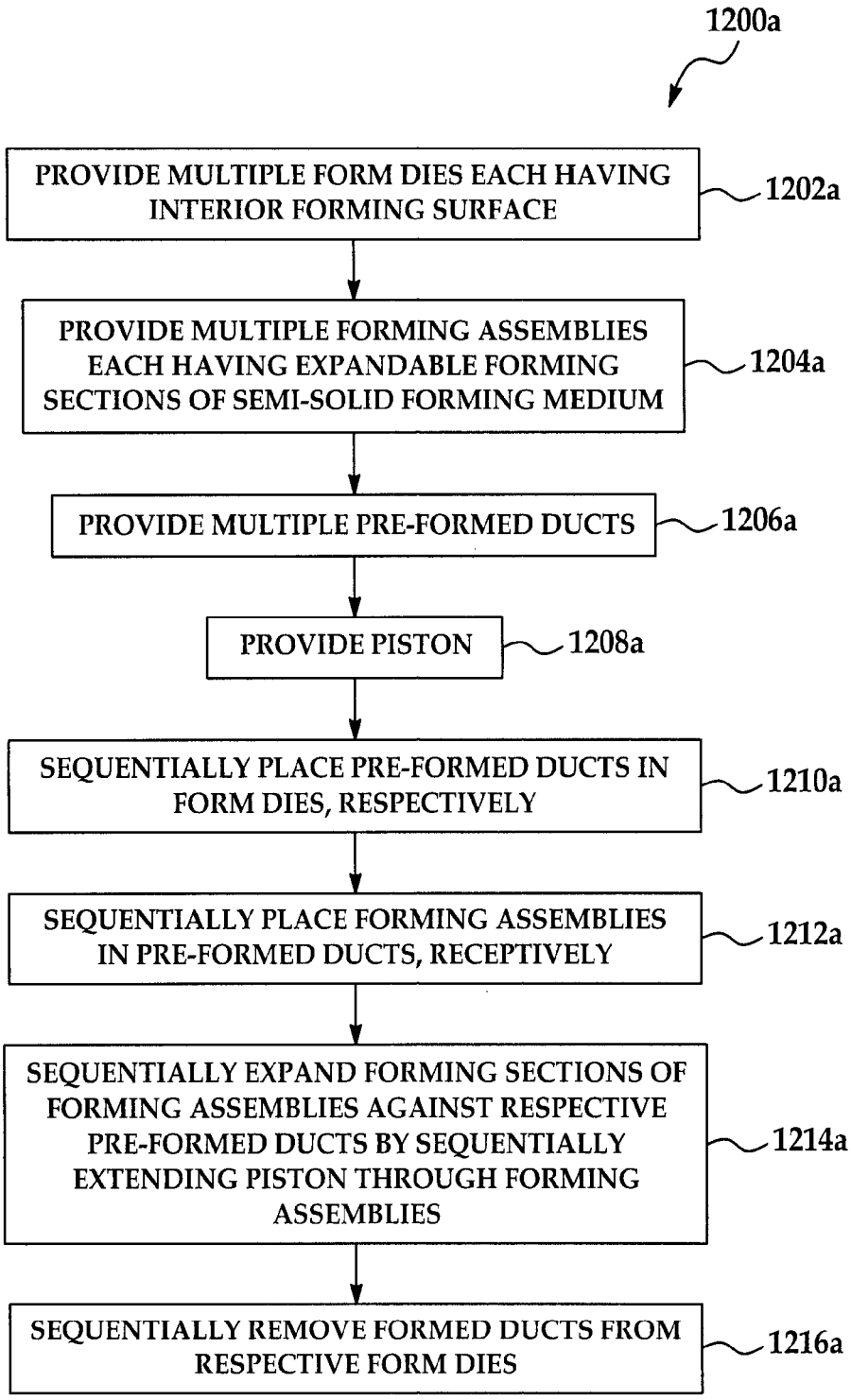
FIG. 12A is a flow diagram which illustrates an illustrative embodiment of a method for sequentially forming multiple net-shaped ducts.

Referring next to FIG. 12A, a flow diagram 1200*a* which illustrates an illustrative embodiment of a method for sequentially forming multiple net-shaped ducts is shown. In block 1202*a*, multiple form dies each having an interior forming surface are provided. In block 1204*a*, multiple forming assemblies each having an expandable forming section of a semi-solid forming medium are provided. In block 1206*a*, multiple pre-formed ducts are provided. In block 1208*a*, a piston is provided. In block 1210*a*, the pre-formed ducts are sequentially placed in the respective form dies. In block 1212*a*, the forming assemblies are sequentially placed in the respective pre-formed ducts. In block 1214*a*, the forming sections of the forming assemblies are sequentially expanded against the respective pre-formed ducts by sequentially extending the piston through the respective forming assemblies. In block 1216*a*, the formed ducts are sequentially removed from the respective form dies.

Figure 12B:
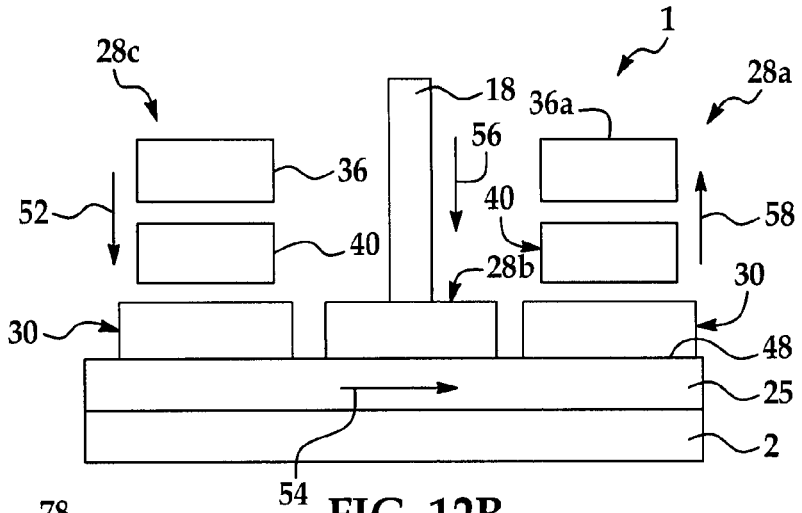
FIG. 12B is a block diagram of an illustrative embodiment of the net-shaped duct forming apparatus.

Referring next to FIG. 12B, a block diagram which illustrates an illustrative embodiment of a net-forming apparatus 1 is shown. The net-forming apparatus 1 may include a support frame 2 on which is provided a support platform 25 movable on the support frame 2 in the direction indicated by the arrow 54. A forming piston 18 may be disposed above the support platform 25. Duct-shaping assemblies 28*a*, 28*b* and 28*c* may be progressively assembled on the support platform 25. Accordingly, a form die 30 may be placed on the support platform 25; a forming assembly 40 may be placed in the form die 30; and a pre-formed duct 36 may be placed in the forming assembly 40 to assemble each duct-forming assembly 28*a*, 28*b* and 28*c*, as shown with respect to the third duct-shaping assembly 28*c* and indicated by the arrow 52.

A formed duct 36*a* may be formed from each pre-formed duct 36 by extending the forming piston 18 into the forming assembly 40 of each duct-shaping assembly 28*a*, 28*b* and 28*c*, as shown with respect to the second duct-shaping assembly 28*b* and indicated by the arrow 56, thereby forcing the forming assembly 40 outwardly against the preformed duct 36 and the pre-formed duct 36 outwardly against the interior surfaces of the form die 30. In the foregoing manner, the duct-shaping assemblies 28*a*, 28*b* and 28*c* are progressively moved on the support platform 25 beneath the forming piston 18 to form the formed ducts 36*a*. When each duct-shaping assembly 28*a*, 28*b* and 28*c* reaches the unloading position 48 on the support platform 25, the forming assembly 40 may be removed from the form die 30 and the formed duct 36*a* may be removed from the forming assembly 40, as indicated by the arrow 58.

Figure 13:
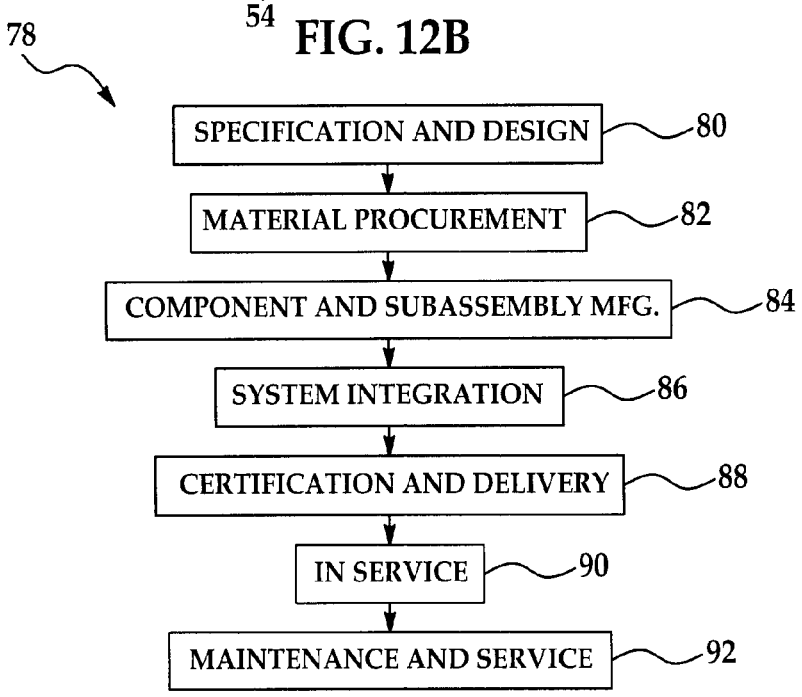
FIG. 13 is a flow diagram of an aircraft production and service methodology.
Figure 14:
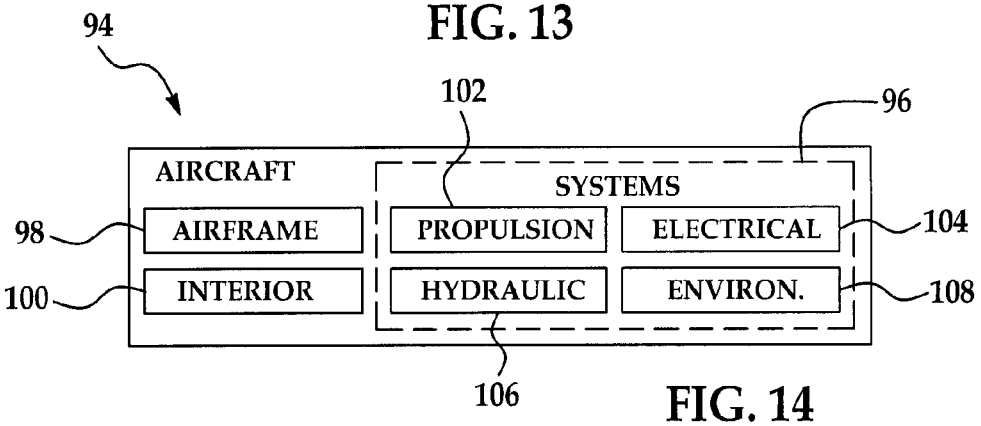
FIG. 14 is a block diagram of an aircraft.

Referring next to FIGS. 13 and 14, embodiments of the disclosure may be used in the context of an aircraft manufacturing and service method 78 as shown in FIG. 13 and an aircraft 94 as shown in FIG. 14. During pre-production, exemplary method 78 may include specification and design 80 of the aircraft 94 and material procurement 82. During production, component and subassembly manufacturing 84 and system integration 86 of the aircraft 94 takes place. Thereafter, the aircraft 94 may go through certification and delivery 88 in order to be placed in service 90. While in service by a customer, the aircraft 94 may be scheduled for routine maintenance and service 92 (which may also include modification, reconfiguration, refurbishment, and so on).

Each of the processes of method 78 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 14, the aircraft 94 produced by exemplary method 78 may include an airframe 98 with a plurality of systems 96 and an interior 100. Examples of high-level systems 96 include one or more of a propulsion system 102, an electrical system 104, a hydraulic system 106, and an environmental system 108. Any number of other systems may be included. Although an aerospace example is shown, the principles of the invention may be applied to other industries, such as the automotive industry.

The apparatus embodied herein may be employed during any one or more of the stages of the production and service method 78. For example, components or subassemblies corresponding to production process 84 may be fabricated or manufactured in a manner similar to components or subassemblies produced while the aircraft 94 is in service. Also, one or more apparatus embodiments may be utilized during the production stages 84 and 86, for example, by substantially expediting assembly of or reducing the cost of an aircraft 94. Similarly, one or more apparatus embodiments may be utilized while the aircraft 94 is in service, for example and without limitation, to maintenance and service 92.

Although the embodiments of this disclosure have been described with respect to certain exemplary embodiments, it is to be understood that the specific embodiments are for purposes of illustration and not limitation, as other variations will occur to those of skill in the art.

What is claimed is:

1. A duct-forming apparatus, comprising:

an apparatus frame;

a forming piston assembly having a cylinder carried by said apparatus frame and a forming piston extendable from said cylinder; and a duct-shaping assembly comprising:

a form die having a form die interior and a forming surface provided in said form die interior, the forming surface having a shape desired for a pre-form duct;

the pre-form duct disposed inside the form die interior; and a forming assembly disposed inside the pre-form duct, the forming assembly comprising:

a first assembly plate having a first opening;

a plurality of expandable forming sections each having a corresponding opening that is about co-axial with both the first opening and other openings of other ones of the plurality of expandable forming sections, the plurality of expandable forming sections stacked over the first assembly plate; and a second assembly plate having a second opening about co-axial with the first opening, the second assembly plate in contact with one of the plurality of expandable forming sections and disposed opposite the first assembly plate relative to the plurality of expandable forming sections;

wherein the duct shaping assembly is aligned with the forming piston assembly such that the forming piston is extendable through the first opening, through openings in the plurality of expandable forming sections, and through the second opening; and wherein diameters of the openings of the plurality of expandable forming sections are all less than a diameter of the forming piston.

2. The apparatus of claim 1 wherein each of said expandable forming sections comprises a semi-solid medium.

3. The apparatus of claim 1 wherein said apparatus frame comprises an apparatus frame base, a plurality of vertical frame members extending from said apparatus frame base and a plurality of horizontal frame members carried by said vertical frame members, and wherein said cylinder of said forming piston assembly is carried by said horizontal frame members.

4. The apparatus of claim 1 further comprising a support frame and wherein said apparatus frame is carried by said support frame.

5. The apparatus of claim 1 further comprising a traversing apparatus extending through said apparatus frame and wherein said duct-shaping assembly is carried by said traversing apparatus.

6. The apparatus of claim 5 wherein said traversing apparatus comprises a platform base and a support platform carried by said platform base, and wherein said duct shaping assembly is carried by said support platform.

7. The apparatus of claim 6 further comprising at least one platform rail carried by said platform base and wherein said support platform slidably engages said platform rail.

8. The apparatus of claim 1 wherein said expandable forming sections of said forming assembly vary in hardness.

9. The duct-forming apparatus of claim 1, wherein the least one expandable forming section comprises at least two expandable forming sections that differ in hardness relative to each other.

10. The duct-forming apparatus of claim 1, wherein the duct-shaping assembly further comprises a guide collar disposed on the second assembly plate opposite the one expandable forming member.

11. A duct-forming apparatus, comprising:

an apparatus frame having a frame interior;

a forming piston assembly having a cylinder carried by said apparatus frame and a forming piston extendable from said cylinder into said frame interior; and a duct-shaping assembly provided in said frame interior of said apparatus frame and comprising:

a form die having a form die interior and a forming surface provided in said form die interior, the forming surface having a shape desired for a pre-form duct;

the pre-form duct disposed inside the form die interior; and a forming assembly disposed inside the pre-form duct, the forming assembly comprising:

a first assembly plate having a first opening;

a plurality of expandable forming sections each having a corresponding opening that is about co-axial with both the first opening and other openings of other ones of the plurality of expandable forming sections, the plurality of expandable forming sections stacked over the first assembly plate;

a second assembly plate having a second opening about co-axial with the first opening, the second assembly plate in contact with one of the plurality of expandable forming sections and disposed opposite the first assembly plate relative to the plurality of expandable forming sections; and a guide collar disposed on the second assembly plate opposite the one expandable forming member, the guide collar having a third opening about co-axial to the second opening;

wherein the duct shaping assembly is aligned with the forming piston assembly such that the forming piston is extendable through the first opening, through the third opening, through openings in the plurality of expandable forming sections, and through the second opening; and wherein diameters of the openings of the plurality of expandable forming sections are all less than a diameter of the forming piston.

12. The apparatus of claim 11 wherein each of said expandable forming sections comprises a semi-solid medium.

13. The apparatus of claim 11 wherein said apparatus frame comprises an apparatus frame base, a plurality of vertical frame members extending from said apparatus frame base and a plurality of horizontal frame members carried by said vertical frame members, and wherein said cylinder of said forming piston assembly is carried by said horizontal frame members.

14. The apparatus of claim 11 further comprising a support frame and wherein said apparatus frame is carried by said support frame.

15. The apparatus of claim 11 further comprising a traversing apparatus extending through said frame interior of said apparatus frame and wherein said duct-shaping assembly is carried by said traversing apparatus.

16. The apparatus of claim 15 wherein said traversing apparatus comprises a platform base and a support platform carried by said platform base, and wherein said duct shaping assembly is carried by said support platform.

17. The apparatus of claim 16 further comprising at least one platform rail carried by said platform base and wherein said support platform slidably engages said platform rail.

18. The apparatus of claim 11 wherein said expandable forming sections of said forming assembly vary in hardness.

19. The duct-forming apparatus of claim 11, wherein the plurality of expandable forming sections comprises at least two expandable forming sections that differ in hardness relative to each other.

20. A duct-forming apparatus for an aircraft part, comprising:

a support frame;

an apparatus frame having a frame base, a plurality of spaced-apart vertical frame members extending from said frame base, a plurality of horizontal frame members carried by said vertical frame members and a frame interior defined by said frame base, said vertical frame members and said horizontal frame members;

a traversing platform having a generally elongated platform base extending through said frame interior of said apparatus frame and a support platform slidably carried by said platform base;

a forming piston assembly having a cylinder carried by said horizontal frame members of said apparatus frame and a forming piston extendable from said cylinder into said frame interior; and a duct-shaping assembly provided in said frame interior of said apparatus frame and comprising:

a form die having a form die interior and a forming surface provided in said form die interior, the forming surface having a shape desired for a pre-form duct;

the pre-form duct disposed inside the form die interior; and a forming assembly disposed inside the pre-form duct, the forming assembly comprising:

a first assembly plate having a first opening;

a plurality of expandable forming sections each having a corresponding opening that is about co-axial with both the first opening and other openings of other ones of the plurality of expandable forming sections, the plurality of expandable forming sections stacked over the first assembly plate; and a second assembly plate having a second opening about co-axial with the first opening, the second assembly plate in contact with one of the plurality of expandable forming sections and disposed opposite the first assembly plate relative to the plurality of expandable forming sections;

wherein the duct shaping assembly is aligned with the forming piston assembly such that the forming piston is extendable through the first opening, through openings in the plurality of expandable forming sections, and through the second opening; and wherein diameters of the openings of the plurality of expandable forming sections are all less than a diameter of the forming piston.

21. The duct-forming apparatus of claim 20, wherein the plurality of expandable forming sections comprises at least two expandable forming sections that differ in hardness relative to each other.

* * * * *